US006063532A

United States Patent [19]

Miyake

[11] Patent Number: 6,063,532

[45] Date of Patent: May 16, 2000

[54] PHOTORECEPTOR

[75] Inventor: Kan Miyake, Hino, Japan

[73] Assignee: Konica Corporation, Tokyo, Japan

[21] Appl. No.: 09/041,451

[22] Filed: Mar. 12, 1998

[30] Foreign Application Priority Data

Mar. 18, 1997 [JP] Japan ..... 9-064953

[51] Int. Cl.[7] ..... G03G 5/00; G03G 21/00

[52] U.S. Cl. ..... 430/56; 430/69; 430/125; 399/159; 399/346; 399/347; 399/350; 399/359

[58] Field of Search ..... 430/56, 58, 59, 430/69, 125, 57; 399/159, 160, 350, 359, 346, 347

[56] References Cited

U.S. PATENT DOCUMENTS 4,962,008 10/1990 Kimura et al. ..... 430/67
5,362,588 11/1994 Yoshihaka et al. ..... 430/69

FOREIGN PATENT DOCUMENTS 63-80262 4/1988 Japan ..... 430/58

OTHER PUBLICATIONS

Derwent Abstract 88–137427/20 of JP 63–80262 (Pub Apr. 1988) Attached to JP 63–80262.
Shin Etsu Silicone Corporation Technical Data Sheets, p. 1, published Jul. 1997.
Toray Dow Corning Silicone Corporation Technical Data Sheets,pp . 1 & 3, published Mar. 1997.

*Primary Examiner*—Janis L. Dote
*Attorney, Agent, or Firm*—Frishauf, Holtz, Goodman, Langer & Chick, P.C.

[57] ABSTRACT

A photoreceptor for forming an electrophotography is disclosed. The photoreceptor comprises a photosensitive layer in an area excluding both edges in the axial direction on a cylindrical aluminum support and silicon oil on the surface of both edges which have no photosensitive layer on the cylindrical aluminum support.

16 Claims, 5 Drawing Sheets

PHOTORECEPTOR

FIELD OF THE INVENTION

The present invention relates to a photoreceptor.

BACKGROUND OF THE INVENTION

Generally, in an image-forming apparatus employing an electrophotographic method, image exposure is performed onto a photoreceptor to form a latent image. The formed latent image is then developed to form a toner image, which is then transferred to a transfer sheet and thermally fixed, and thus an image is formed. On the other hand, there remains the toner on the photoreceptor which has not been transferred. The residual toner is cleaned by a blade or the like for utilizing repeatedly the photoreceptor.

As a photoreceptor, those have been employed in which a photosensitive layer is coated on an aluminum support. However, when the photoreceptor has a photosensitive layer to both extreme edges and are not involved in the image formation during development, the toner in the developer adheres onto the charged photoreceptor and the excessive toner is consumed or the adhered toner is scattered which stains the interior of the image-forming apparatus and transfer sheets. In order to minimize these problems, the photosensitive layer on the aluminum support is peeled off or removed, and the electrically conductive aluminum support is exposed so that no toner is adhered at both edges of the photoreceptor. Furthermore, unevenly coating occurs very readily at the edges of the photoreceptor during the manufacturing process, and unevenly coated parts tend to cause peeling and cracking over the whole area of the photosensitive layer.

However, the surface of the aluminum support can be subjected to treatment to result in specular gloss on which a photosensitive layer can be uniformly coated. Accordingly, when the blade of a cleaning device is in contact with the surface, adhesion and frictional force increases. Particularly, for example, when with the rotation of the photoreceptor, the blade is brought into contact in the opposite rotational direction, the edge of the blade follows the surface of the photoreceptor in accordance with the frictional force, and a problem occurs in that the edge of the blade is distorted into a curl shape.

In order to solve this problem, Japanese Patent Publication Open to Public Inspection No. 5-150696 discloses a technique in which when the torque against the cleaning blade by the uppermost layer of the photoreceptor is 4.0 kg·cm or more, tendency of the curl distortion of the blade edge is minimized by employing a material which enables the reduction of the torque of the edge of the blade by 0.5 kg·cm or more.

However, the above-mentioned technique is not particularly effective for this problem in that the edge of a fresh blade is curled when being pulled by the photoreceptor. Furthermore, during usage over a long time, the surface is subjected to abrasion by the blade to result in a smooth surface, and as a result, the adhesion with the blade increases. Thus, the above-mentioned technique does not substantially solve the problem.

Furthermore, Japanese Patent Publication Open to Public Inspection No. 6-258995 discloses a technique in which improvement is achieved by the formation of minute unevenness on the surface to decrease the friction coefficient, and proposes that when the minute unevenness is formed, the surface treatment is performed in advance, providing an abrasive means such as a brush or coating a abrasive material. In this technique, the unevenness is formed on the surface and some effect for decreasing friction is realized. However, the toner tends to be accumulated on the unevenness. During long-term use, the toner adheres in the recesses of the formed unevenness and buried in the unevenness while being forcefully pushed with the blade to increase the frictional force which causes a problem in that the blade is curled.

SUMMARY OF THE INVENTION

An object of the present invention is to provide a photoreceptor resulting in no image defects, a manufacturing method of the same, and an image-forming apparatus.

Another object is, in an image-forming apparatus employing a toner-recycled system, to provide a photoreceptor which enables efficient recycling of toner recovered in a cleaning process and results in no image defects, a manufacturing method of the same, and an image-forming apparatus.

A further object is to provide a photoreceptor, which prevents the curl distortion of a blade during initial use, as well as distortion caused by the long-term use, a manufacturing method of the same, and an image-forming apparatus.

The photoreceptor of the present invention comprises a photosensitive layer in the area excluding both edges in the axial direction on a cylindrical aluminum support and a friction reducing material on the surface of both edges which have no photosensitive layer on the cylindrical aluminum support.

This friction reducing material includes organopolysiloxanes. The organopolysiloxanes have a small surface energy; are excellent in abrasion resistance and can keep the lubricating function for a long time. Based on these, the frictional force between the aluminum support and the blade is reduced for a long time and the curl distortion of the blade can be prevented.

The representative examples of organopolysiloxanes are silicone oils. When liquid silicone oil is employed, it is easy to coat it on the photoreceptor. Because the lubricating function is maintained without being subjected to abrasion for a long time and the frictional force can be reduced, no curl distortion is caused for a long time.

In most image-forming apparatuses in which toner recycling is carried out, a cleaning blade is provided in the rotational direction of a photoreceptor and the toner recycling is carried out in a place adjacent to the cleaning blade. In this case, the toner recovering path is formed via the edge of the photoreceptor. As a result, the toner adhered to the edge is transferred to the photosensitive layer to cause image defects, or the recovery efficiency of the toner is decreased. Embodiments of the present invention may solve such problems.

Upon coating a photosensitive layer on an aluminum support, the aluminum support may be exposed by peeling off the photosensitive layer at both edges in the axial direction, or the same parts may be exposed by coating no photosensitive layer at edges in the axial direction. The friction reducing material is coated on such an exposed aluminum support. Thus, the friction reducing material may be readily provided on the edges and this friction reducing material reduces the frictional force of the blade to enable the prevention of the curl distortion of the blade.

The friction reducing material may be diluted with an organic solvent for coating.

The friction reducing material may be dispersed to form an aqueous dispersion and the resulting dispersion may be coated.

A preferred image-forming apparatus may be constituted in which this photoreceptor is employed in a cleaning device in which the toner of the above-mentioned photoreceptor is cleaned by the blade in contact with the photoreceptor in the opposite rotational direction.

DETAILED DESCRIPTION OF THE INVENTION

Figure 1:
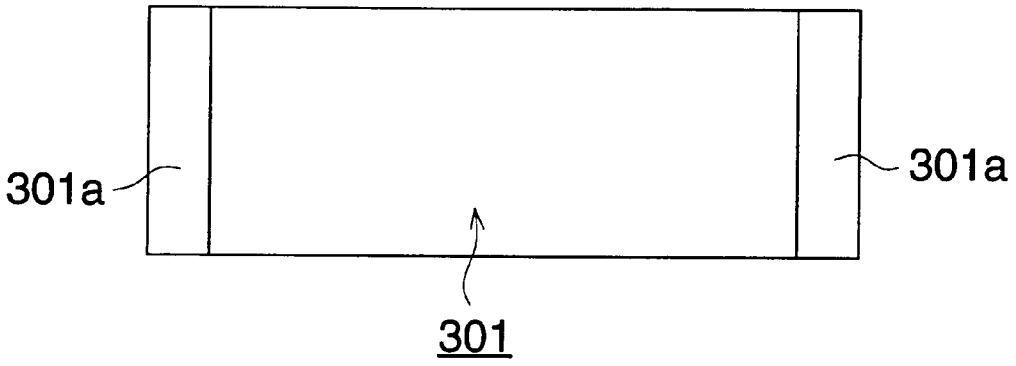
FIGS. 1(*a*) and 1(*b*) are top views showing a photoreceptor at different stages of manufacture.
Figure 1:
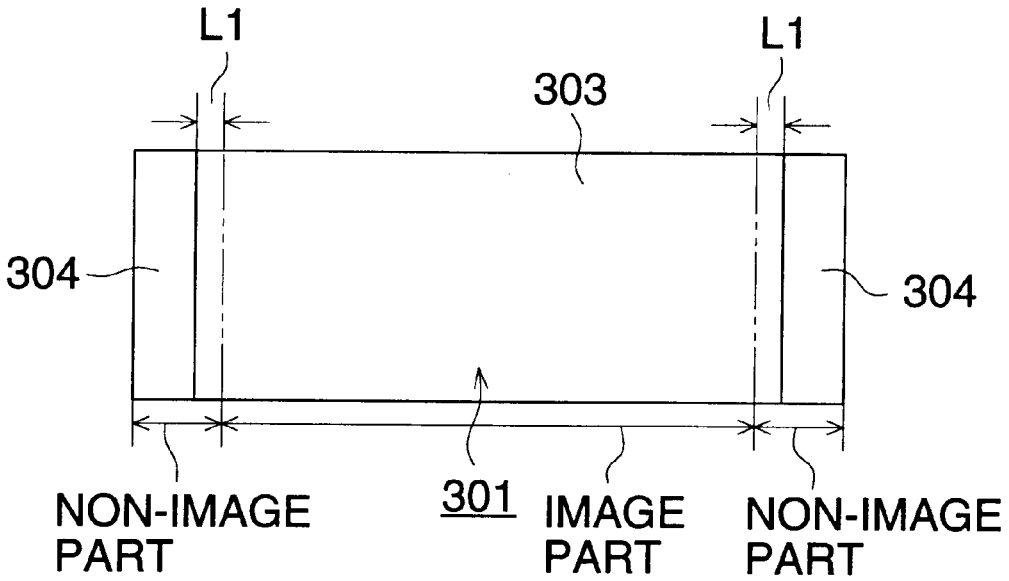
Figure 2:
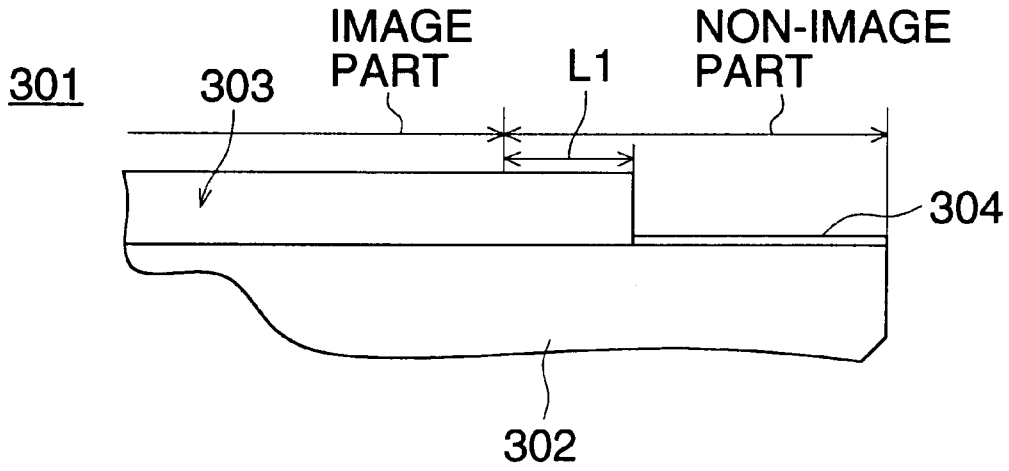
FIG. 2 is a partial view showing a photoreceptor.

Embodiments of the photoreceptor, the manufacturing method of the same and the image-forming apparatus of the present invention are described below. At first, referring to FIGS. 1(*a*), 1(*b*) and 2, the photoreceptor and the manufacturing method thereof are described. FIGS. 1(*a*) and 1(*b*) are top views of the photoreceptor and FIG. 2 is a partial view showing the photoreceptor.

The photoreceptor 301 of the present invention is composed in such a manner that a photosensitive layer 303 is coated on an aluminum support 302, and the photosensitive layer 303 at both edges 301*a* in the axial direction is removed and exposed, or both the edges 301*a* in the axial direction are exposed without coating the photosensitive layer 303 in advance, and on surface of the exposed aluminum support, a friction reducing material layer 304 is coated. This friction reducing material layer 304 reduces the frictional force between the surface of the aluminum support and a blade, and may prevent the formation of the curl distortion of the blade.

The photosensitive layer 303 is composed of a single layer or a plurality of layers. The single layer designates a layer comprising at least a mixture of a carrier generating material and a carrier transport material. The multilayered constitution designates at least two layers consisting of one layer comprising at least a carrier generating material and the other layer comprising at least a carrier transport material.

An image part on the photoreceptor 301 is formed in the inside of the predetermined range L1 at both sides of the photosensitive layer 303, and the non-image part is formed in both outsides of the image part. In the predetermined range L1 of the both sides of the photoreceptor, a non-image range is formed, and toner images are formed in the image part.

The photosensitive layer 303 is composed of a under coating layer, a charge generating layer (CGL), a charge transport layer (CTL), a protective layer, etc., layered on the aluminum body 302.

The surface of the aluminum support 302 employed for this photoreceptor 301 is subjected to specular gloss treatment. The photoreceptor 301 is formed in a drum shape. For example, the outer diameter is between 60 and 80 mm and the length is between 345 mm and 355 mm.

As the friction reducing material layer 304 employed in the present invention, organopolysiloxanes are preferred and silicone oils are particularly preferred. Of friction reducing materials, because the organopolysiloxanes have small surface energy; are excellent in friction resistance and can maintain lubricating function over a long time, they can reduce the frictional force between the surface of the aluminum support and the blade, and can prevent the formation of the curl distortion of the blade for an extended period of time. Furthermore, the silicone oil in liquid state among organopolysiloxanes is readily coated onto the photoreceptor; the coated photoreceptor is not subjected to removing; the lubricating action is maintained over a long time and the frictional force can be remarkably reduced. As a result, the curl distortion of the blade is not caused for a long time. Furthermore, friction reducing materials include those such as fluorine contained resins which are removed to render the low friction, those which render the friction reducing effect due to a spacer effect of the fine particles or the like. However, those friction reducing materials enter an image forming zone and may cause image defects. However the silicone oil can solve these problems.

The manufacturing method of the photoreceptor of the present invention is that the photosensitive layer 303 is coated on the aluminum support 302, and the photosensitive layer 303 at both edges 301*a* (see FIG. 1(*a*) in the axial direction of the photoreceptor 301 is removed and exposed, or both the edges 301*a* of the axial direction are exposed without coating the photosensitive layer 303 in advance, and the friction reducing material layers 304 are coated on the surfaces of the exposed aluminum support, as shown in FIG. 1(*b*).

These friction reducing material layers 304 are prepared by coating, on the surface of the exposed aluminum support, the friction reducing material diluted with an organic solvent, followed by wiping off the excessive friction reducing material, if desired. Specific coating methods include; (1) a friction reducing material is impregnated with nonwoven fiber which is employed for coating; (2) a friction reducing material is impregnated with a plastic foam such as MOLTPLAIN which is employed for coating; (3) a friction reducing material is impregnated with a cotton swab which is employed for coating and the like. In any of these methods, after coating, an excessive friction reducing material is preferably wiped off with dry cloth such as nonwoven fiber. If the excessive friction reducing material remains, a toner, polyvinylidene fluoride, etc. may occasionally adhere.

The friction reducing material is coated so as to have a thickness of 0.03 to 0.1 $\mu$m. The thickness of a layer formed by the friction reducing material is preferably thinner than the photosensitive layer. As organic solvents, there are employed isopropyl alcohol, toluene, acetone, methyl ethyl ketone, 1,2-dichloroethane, etc. Furthermore, it is possible to coat the friction reducing material which is directly dissolved in an organic solvent. However, it is preferred to coat a dispersion in an aqueous emulsion state which is prepared by dissolving the friction reducing material in an organic solvent, followed by dispersing the resulting solution into water. When the organic solvent is directly coated, the photosensitive layer is dissolved out to some extent and resins besides those of the friction reducing material is mixed and remains on the surface. As a result, the excellent lubricating function of the friction reducing materials can not occasionally be exhibited fully.

One example method is described below. Silicone oil as the friction reducing material which is dispersed into an aqueous emulsion state is impregnated with a pad. Employing the impregnated pad, coating is performed on the surface of an aluminum suport and the excessive silicone oil dispersed into the aqueous emulsion state is wiped off with dry cloth. The employed pad is prepared by paper, absorbent cotton, chemical fiber or nonwoven fiber. Among these, the nonwoven fiber is preferred since it forms little dust, flocks, etc.

The aqueous emulsion of the present invention is prepared by dispersing silicone oil as the friction reducing material, an organic solvent and a surface active agent as a dispersing agent into water. After coating, the water and organic solvent are evaporated. This method is suitable for providing fine amount of silicone oil on the surface of the aluminum support.

As the silicone oil as the friction reducing material employed in the present invention, compound represented by the following formula:

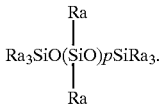

In the formula, Ra is independently an alkyl, alkoxy, phenyl or alkylphenyl group, each of which may have a substituent, p is not more than 4000.

The silicone oil preferably has viscosity of 0.65 to 1,000,000 cST, more preferably 5,000 to 100,000 cSt, most preferably 5,000 to 50,000 cSt.

The silicone oil suitably used in the invention is following compound:

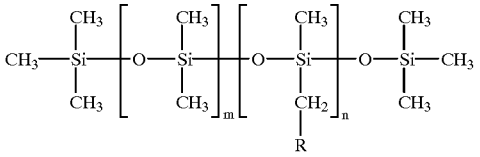

wherein R represents a hydrogen atom, an alkyl group having 1 to 3 carbon atoms, an alkoxy group having 1 to 3 carbon atoms, a phenyl group, an alkylphenyl group, an oxyethyl group, or an oxypropyl group, and m is an integer of 0 to 2,000, and n is an integer of 0 to 2,000, provided that sum of m and n is more than zero, and preferably more than 10, and most preferably more than 100.

Specifically, there may be listed dimethylsilicone oil (SH200, manufactured by Toray Silicone Co., Ltd.; KF96, manufactured by Shin-Etsu Kagaku Kogyo Co., Ltd.; TSF451, manufactured by Toshiba Silicone Co., Ltd.), methylphenyl silicone oil (SH510 manufactured by Toray Silicone Co., Ltd.; KF10 manufactured by Shin-Etsu Kagaku Kogyo Co., Ltd.; TSF431 manufactured by Toshiba Silicone Co., Ltd.). Furthermore, there may be employed compounds, in which R in the above-mentioned general formula is modified with a functional group, such as alkyl-modified silicone, allyl-modified silicone, alkoxy-modified silicone, oxyalkyl-modified silicone, fluorine-modified silicone, glycol-modified silicone, polyether-modified silicone, fatty acid ester-modified silicone, etc.

Figure 3:
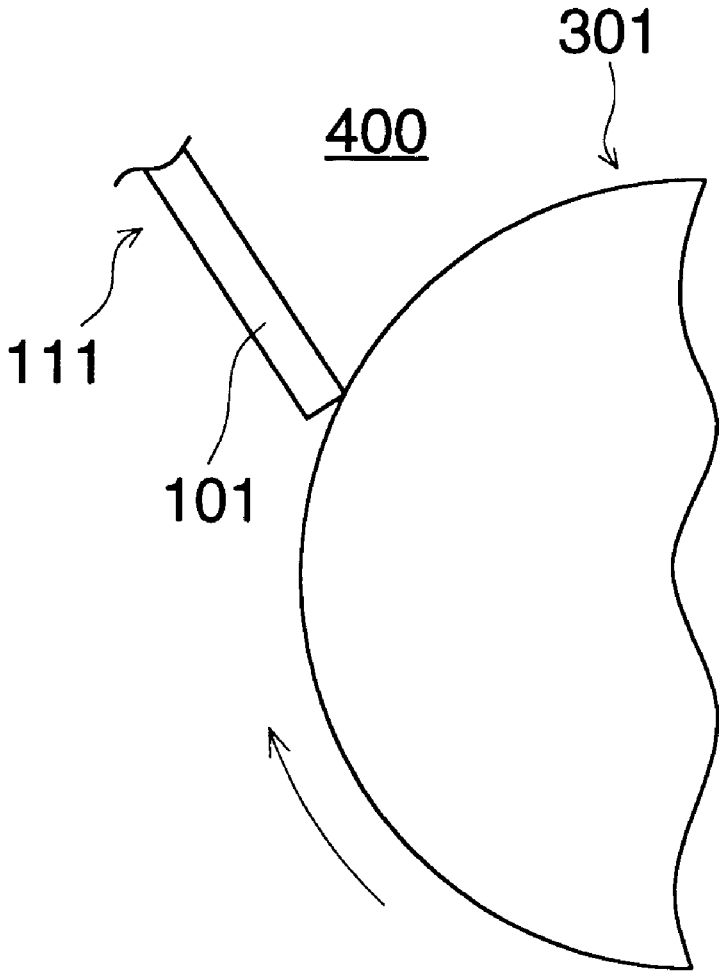
FIG. 3 is a schematic view showing the relation between a photoreceptor and a cleaning blade.

Next, an image-forming apparatus shown in FIG. 3 is described. This image-forming apparatus 400 comprises a photoreceptor 301 and a cleaning device 111 which cleans toner on the photoreceptor 301 employing a blade 101.

Furthermore, the rotation direction of the photoreceptor 301 is shown by an arrow. The blade 101 is in contact with the photoreceptor 301 in the opposite rotational direction. Because the blade 101 particularly is in contact with the photoreceptor 301 in the opposite rotational direction, the blade 101 tends to curl with pulling by the photoreceptor 301. However, when the friction reducing material is coated, the frictional force between the surface of the aluminum support and the blade 101 decreases and the curl distortion of the fresh blade 101 can be minimized.

As the blade, urethane rubber is preferred and the hardness is preferably between 65 and 70 degree. When the hardness is too small, the curl distortion tends to be caused due to the low stiffness of the blade 101. When the hardness is too large, the photoreceptor is subjected to abrasion to result in the smooth surface and the frictional force increases.

As mentioned above, in the image-forming apparatus shown in FIG. 3, a photosensitive layer 303 is coated on an aluminum support 302 and the photosensitive layer at both edges in the axial direction is removed and exposed, or both the edges in the axial direction is exposed without coating a photosensitive layer in advance, and the photoreceptor 301 is provided in which a friction reducing material layer 304 is coated on the exposed surface of the aluminum support. In the image-forming apparatus shown in FIGS. 4 to 6, the photoreceptor 301 is coated on the aluminum support 302, and the photosensitive layer 303 at both edges in the axial direction of the photoreceptor 301 is removed and exposed, or both the edges in the axial direction are not coated with a photosensitive layer in advance.

Figure 4:
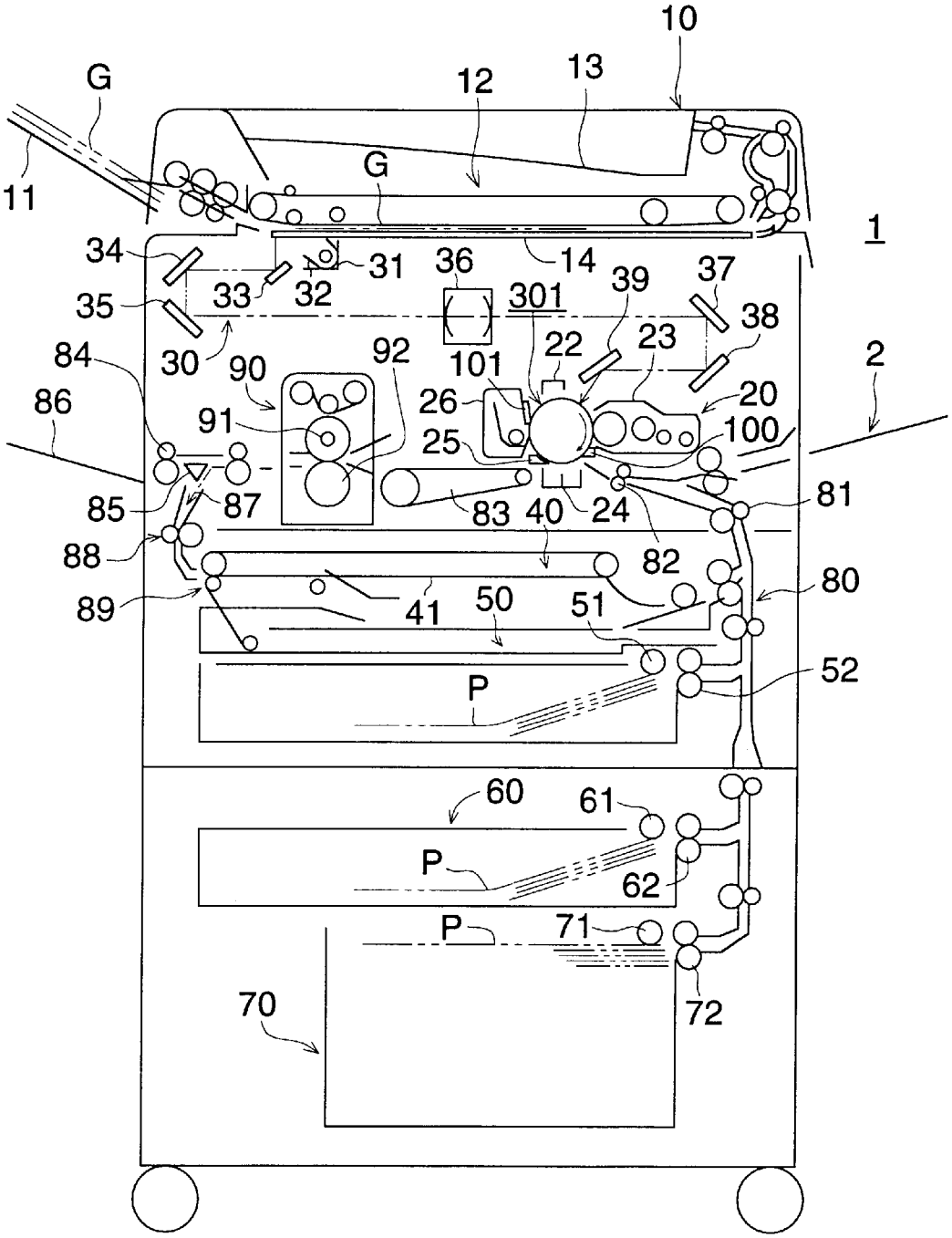
FIG. 4 is a schematic view showing the general constitution of an image-forming apparatus.
Figure 5:
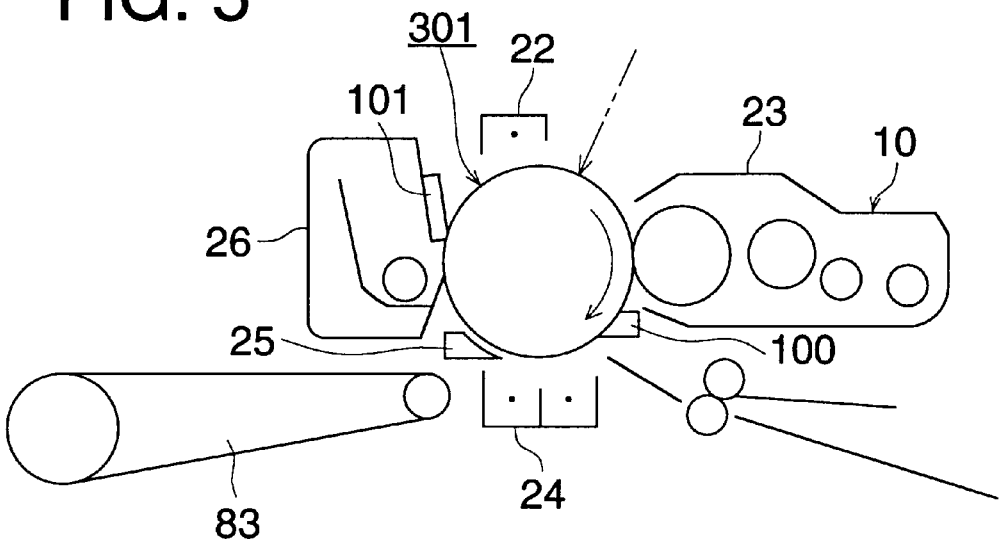
FIG. 5 is a front view showing an arrangement of an image-forming section.
Figure 6:
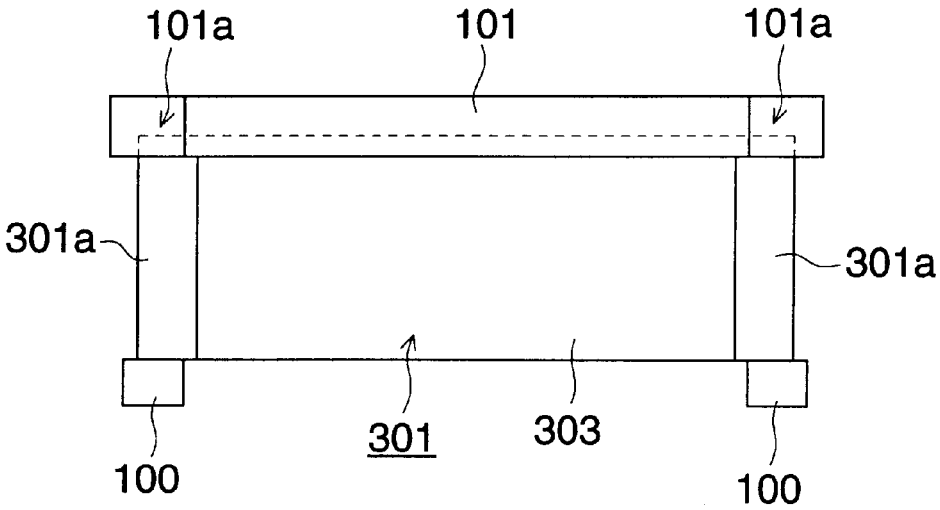
FIG. 6 is a top view showing an arrangement of a blade and an abrasive member.

The image-forming apparatus having the above-mentioned embodiments is described below. FIG. 4 is a general schematic view of an image-forming apparatus; FIG. 5 is a front view showing an arrangement of a image-forming section, and FIG. 6 is a top view showing an arrangement of a blade and an abrasive member.

In the upper part of an image-forming apparatus 1, an automatic original document conveying device 10 is provided and an original document G placed on an original document placing tray 11 is conveyed onto an original document placing platen 14. The original document placed on this original document placing platen 14 is ejected to an original document receiving section 13 by the conveyance mechanism 12 with timing of exposure completion.

In the image-forming apparatus 1, around a photoreceptor 301 in a drum shape, which is a latent image-forming means, a charging device 22, a development device 23, a transfer device 24, a separation device 25, a cleaning device 26 are arranged in the order of operation and these devices are integrated to an image-forming unit 20. The photosensitive layer of the photoreceptor 301 is charged by the charging device 22, and exposure then starts onto the original document G placed on the original document placing platen 14 provided in the uppermost part in the image-forming apparatus 1, employing an exposure lamp 32 provided in an optical frame 31 of an exposure optical unit 30 arranged in the upper position in the image-forming apparatus 1; and an electrostatic latent image is formed on the surface of the photosensitive layer of the photoreceptor 301 by exposure from the arrow direction employing a mirror 33 moving integrally with the exposure lamp 32, mirrors 34 and 35 arranged in a V shape and moving one half distance of that of the mirror 33, mirrors 37 and 38 arranged in a V shape via a focusing lens 36, and a mirror 39 irradiating an image onto the photoreceptor 301.

Thereafter, the electrostatic latent image is developed by the development unit 23 in the image-forming unit 20 and the visualized toner image is formed on the surface of the photosensitive layer of the photoreceptor 301. Further, in the image-forming unit 1, at the lower and vertical position, a sheet-feeding unit for both-sided copying, and sheet-feeding units 50 and 60 are arranged and in sheet-feeding units 50, 60 and 70, copy sheets P in different sizes are loaded. For example, when the copy sheets P loaded in the sheet-feeding unit 50 are chosen, one of copy sheets P is fed by a sheet-feeding roller 51 and conveyed by a guide roller 52. In the similar manner, when copy sheets P loaded in the sheet-feeding units 60 and 70 are chosen, one of copy sheets P is only fed by sheet-feeding rollers 61 and 71, and conveyed by a guide rollers 62 and 72.

A copy sheet P is conveyed through a conveyance path 80 by a conveyance mechanism 81 to the direction of the photoreceptor 301 on which the toner image has been formed. The copy sheet once stopped by registration rollers 82 provided in the image-forming apparatus 1 and is fed so that the toner image formed on the photoreceptor 301 and the copy sheets P are registered.

Next, the toner image on the photoreceptor 301 is transferred to the copy sheet P by the transfer device 24, and the copy sheet P is separated from the surface of the photoreceptor 301 by the separation device 25 and conveyed to a fixing device 90 by a conveyance device 83. The fixing device 90 is composed of a heat fixing roller 91 and an application roller 92, and the toner image on the copy sheet P is brought into pressure contact with the heat fixing roller 91 and fixed on the copy sheet P. The copy sheet P completing fixation is ejected by sheet-ejecting guide rollers 84. In the case of one-sided copying, a sheet ejection-switching member 85 descends and the copy sheet P is ejected to a sheet-ejecting tray 86, as it is. In the case of both-sided copying, the sheet ejection-switching member 85 ascends and a copy sheet guide section 87 is open and the copy sheet P is conveyed to the dotted arrow direction. Furthermore, the copy sheet P is conveyed downward by a conveyance mechanism 88 and the leading edge of the copy sheet P is conveyed under the sheet-feeding unit 50 by a copy sheet-reversing section 89 and the copy sheet P is reversed and conveyed. The reversed copy sheet P is conveyed to the sheet-feeding unit 40 for both-sided copying.

The copy sheet P is conveyed to the sheet-feeding direction by a conveyance belt 41 provided in the sheet-feeding unit 40 and the copy sheet P is fed again by the sheet-feeding roller and the copy sheet P is guided to the conveyance path 80 by the conveyance roller. As mentioned above, the copy sheet P is again conveyed to the direction of the photoreceptor 301, and a toner image is transferred to the back side of the copy sheet P which is fixed in the fixing device 90 and then ejected to the sheet-ejecting tray 86. In the image-forming apparatus 1, a manual sheet feeding device 2 is provided.

Both edges of the photoreceptor 301 have no photosensitive layer 303 and the aluminum support itself is exposed. The surface of the exposed aluminum support at both edges 301*a* in the axial direction is preferably brought into contact with an abrasive member 100. Furthermore, it is preferred to previously coat the friction reducing material on both the edges of the photoreceptor. In this way, by bringing the surface of the aluminum support in both the edges of the photoreceptor 301 into contact with the abrasive member 100, with the rotation during use, minute unevenness is formed on the surface of the aluminum support of the photoreceptor 301 and the surface is changed from a mirror surface condition to a roughened surface condition, and the frictional force with the blade 101 of the cleaning device 26, which is brought into contact with the aluminum surface in the opposite rotational direction, is more reduced (decrease in adhesion) to enable the prevention of the curl distortion of the blade. It is preferred to bring the whole surface of the exposed aluminum support of the photoreceptor 301 into contact with the abrasive member 100 so that silicone oil can be coated. At least, the contact is performed so that silicone oil can be coated on 50 to 100 percent of the surface of the exposed aluminum support, in such a manner that the curl distortion of the blade is hardly caused.

The abrasive member is composed of a plastic foam member such as plastic form, etc. Polyurethane foam which exhibits little abrasion is preferred. By employing the plastic foam member, the surface of the aluminum support of the photoreceptor 301 can be economically, efficiently changed from a mirror surface condition to a roughened surface condition under easiness for the contact arrangement. An example of the abrasive member 100 is "MOLTPLAIN" (registered trademark) among polyurethane foams.

Furthermore, the abrasive member 100 is impregnated with a friction reducing material which is preferably coated. The surface of the aluminum support is roughened and coated with the friction reducing material. As a result, during extended usage, toner hardly adheres. Though the toner adheres, the toner is readily removed by a blade. The toner does not adhere and is not accumulated in the recesses of the uneven surface. Thus, the curl distortion of a fresh blade is minimized and further, for extended usage, the curl distortion can be prevented. The representative friction reducing material is the above-mentioned silicone oil which may be employed for coating as it is. Or the silicone oil is dissolved in an organic solvent and the resulting solution may be coated, or is dispersed into water together with an organic solvent and the resulting dispersion may be coated.

Furthermore, in the blade 101, at least, a part 101*a* in contact with the surface of the aluminum support is preferably coated with a fluorine series resin. During initial usage of the photoreceptor 301, the part 101*a* of the blade coated with the fluorine series resin is brought into contact with the surface of the aluminum support of both edges 301*a* in the axial direction of the exposed photoreceptor. As a result, the frictional resistance is decreases to prevent the curl distortion. Around the time when the part coated with the fluorine series resin is eliminated with abrasion during usage, the surface is changed by the abrasive member 100 from a mirror surface condition to an uneven surface condition and is coated with the friction reducing material. As a result, the friction with the blade 101 decreases and from initial use to extended use, the curl distortion is not caused.

The arrangement position of the abrasive member 100 is not particularly limited. However, when it is arranged between the development device 23 and the cleaning device 26, a room for the arrangement of the abrasive member 100 is readily secured and it is arranged at the lower position against the center of the photoreceptor 301. Thus, fine particles generated by roughening the surface of the aluminum support of both edges 301*a* in the axial direction of the exposed photoreceptor 301 from the mirror surface condition to the uneven surface condition fall downward and are prevented from adhering to the photosensitive layer. Furthermore, a plurality of abrasive members may be arranged.

Examples are shown below.

(Preparation of Photoreceptor 1)

On a mirror surface polished aluminum support having an outer diameter of 60 mm, an interlayer having a length of 345 mm and a thickness of 0.1 μm was provided which was composed of a vinyl chloride-vinyl acetate-maleic acid copolymer resin. Thereafter, 120 g of 4,10-dibromanthanthrone pigment was added with a solution prepared by dissolving 60 g of polycarbonate resin "PAN-LIGHT L-1250" (manufactured by Teijin Kasei Co., Ltd.) in 400 ml of 2-dichloroethane. The resulting mixture was dispersed on a ball mill. The obtained dispersion was dip-coated on the interlayer and a charge generating layer having a thickness of 1.0 μm was formed.

Next, 660 g of polycarbonate resin UPIRON Z-300 (manufactured by Mitsubishi Chemical Corporation) was dissolved in 4,000 ml of dichloroethane and the resulting solution was dip-coated on the above-mentioned charge generating layer and was dried at 100° C. for one hour to form a charge transport layer having a thickness of 25.0 μm.

Edges with each length of 20 mm of the photosensitive layer of the photoreceptor on which the above-mentioned photosensitive layers was coated were removed by the nonwoven fiber impregnated with methylene chloride and the surface of the aluminum support was exposed. An aqueous emulsion was prepared by adding one percent dimethylsilicone oil (KF-96; manufactured by Shin-Etsu Kagaku Kogyo Co., Ltd.) toluene solution to water together with a surface active agent followed by mixing and dispersing the resulting mixture. This aqueous emulsion was coated on the surface of the exposed aluminum support. Silicone oil of 0.1 μm thickness was provided. After drying, the coating was wiped with dry cloth and "Photoreceptor 1" was prepared.

(Preparation of Photoreceptor 2)

Photoreceptor 2 was prepared in the same manner as for Photoreceptor 1, except that methylphenylsilicone oil (KF-54; manufactured by Shin-Etsu Kagaku Kogyo Co., Ltd.) was employed instead of dimethylsilicone oil. Silicone oil of 0.05 μm thickness was provided.

(Preparation of Photoreceptor 3)

Photoreceptor 3 was prepared in the same manner as for Photoreceptor 1, except that methylphenylsilicone oil (KF-54; manufactured by Shin-Etsu Kagaku Kogyo Co., Ltd.) was diluted in isopropyl alcohl to make 20 ppm solution, and the solution was coated through non-web fiber. Methylphenylsilicone oil of 0.05 μm thickness was provided.

(Preparation of Comparative Photoreceptor)

"Comparative Photoreceptor" which is not coated with a friction reducing material was prepared in the same manner as for "Photoreceptor 1", except that dimethylsilicone oil was not employed.

(Practical Image Formation)

Employing Photoreceptors 1 and 2, and Comparative Photoreceptor, the image-forming test of 30,000 sheets for each was carried out using the copier, KONICA 3240 installed with a toner-recycling system. Further, in this case, the test was carried out removing the abrasive member 100.

Further, the cleaning blade employed in this practical image-forming test was a urethane rubber blade having hardness of 67 degree (measured by JIS Spring Hardness Measuring Apparatus according to JIS K6801) and the each of end portion was subjected to surface treatment with fluoroacrylate resin.

According to results, when Photoreceptors 1, 2 and 3 were employed, no curl distortion of the blade was caused from initial image-forming to 30,000-sheet image-forming. When Comparative Photoreceptor was employed, same tests were carried out five times and in all the tests, the curl distortion was caused within 1,000 sheets in the initial run.

Employing Photoreceptors 1, 2 and 3, and Comparative Photoreceptor, image-forming tests of 100,000 sheets were carried out in the same way as for Practical Image Formation Test 1, except that the abrasive member 100 was mounted in KONICA 3240. Further, the abrasive member was impregnated with silicone oil which was similar to that applied to the friction reducing member employed in the photoreceptor. According to results, when Photoreceptors 1, 2 and 3 were employed, no curl distortion of the blade was caused from initial image-forming to that of 100,000 sheets. When Comparative Photoreceptor was employed, the same tests were carried out five times and in all the tests, the curl distortion was caused within image-forming of 1,000.

The photoreceptor is prepared by coating a friction reducing material on the surface of an photosensitive layer-exposed aluminum support and this friction reducing material decreases the frictional force between the surface of the aluminum support and a blade to prevent the curl distortion of the blade.

I claim:

1. A photoreceptor comprising a photosensitive layer in an area excluding both edges in the axial direction on a cylindrical aluminum support and silicone oil on the surface of both edges which have no photosensitive layer on the cylindrical aluminum support.

2. The photoreceptor of claim 1, wherein the silicone oil is represented by a formula of

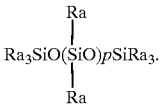

wherein Ra is independently an alkyl, alkoxy, phenyl or alkylphenyl group, each of which may have a substituent, p is not more than 4000.

3. The photoreceptor of claim 2, wherein thickness of the silicone oil is 0.03 to 0.1 μm.

4. The photoreceptor of claim 1, wherein viscosity of the silicone oil at 25° C. is 5,000 to 50,000 cSt.

5. The photoreceptor of claim 1, wherein the silicone oil is represented by a formula of

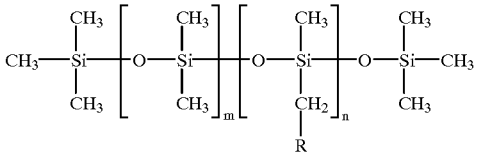

wherein R represents a hydrogen atom, an alkyl group having 1 to 3 carbon atoms, an alkoxy group having 1 to 3 carbon atoms, a phenyl group, an alkylphenyl group, an oxyethyl group, or an oxypropyl group, and m is an integer of 0 to 2,000, and n is an integer of 0 to 2,000, provided that sum of m and n is more than zero.

6. The photoreceptor of claim 5, wherein the sum of m and n is more than 10.

7. The photoreceptor of claim 5, wherein the sum of m and n is more than 100.

8. The photoreceptor of claim 5, wherein thickness of the silicone oil is 0.03 to 0.1 μm.

9. The photoreceptor of claim 1, wherein thickness of the silicone oil is 0.03 to 0.1 μm.

10. The photoreceptor of claim 1, wherein the silicone oil is provided by coating the silicone oil diluted with an organic solvent.

11. The photoreceptor of claim 1, wherein the silicone oil is provided by coating aqueous dispersion of silicone oil.

12. An image forming apparatus comprising the photoreceptor of claim 1 and a cleaning device in which toner on the photoreceptor is cleaned by a blade in contact with the photoreceptor in the opposite rotational direction.

13. The image forming apparatus of claim 12, wherein toner recycling is carried out in a place adjacent to cleaning blade.

14. The image forming apparatus of claim 12, wherein the cleaning blade is made of urethane rubber.

15. The image forming apparatus of claim 12, further comprising an abrasive member in contact with the surfaces at both edges in the axial direction on the cylindrical aluminum support which have no photosensitive layer on the cylindrical aluminum support of the photoreceptor.

16. The image forming apparatus of claim 15, wherein the abrasive member is coated with a silicone oil.

* * * * *